US007621792B2

(12) United States Patent
Fukuoka et al.

(10) Patent No.: US 7,621,792 B2
(45) Date of Patent: Nov. 24, 2009

(54) OUTBOARD MOTOR

(75) Inventors: Yoshihito Fukuoka, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 27 days.

(21) Appl. No.: 11/954,093

(22) Filed: Dec. 11, 2007

(65) Prior Publication Data

US 2008/0146095 A1 Jun. 19, 2008

(30) Foreign Application Priority Data

Dec. 19, 2006 (JP) ..... 2006-341327

(51) Int. Cl.
*B63H 21/00* (2006.01)

(52) U.S. Cl. ..... 440/89 R

(58) Field of Classification Search ..... 440/49, 440/52, 59, 75, 76, 79, 80, 83, 89 R
See application file for complete search history.

(56) References Cited

U.S. PATENT DOCUMENTS 3,025,822 A * 3/1962 Tenney ..... 416/93 R
4,747,795 A * 5/1988 Kawamura et al. ..... 440/75
4,881,370 A 11/1989 Sakurai et al.
5,403,218 A 4/1995 Onoue et al.
5,766,048 A * 6/1998 Iwashita ..... 440/89 R
5,888,108 A 3/1999 Iriono
6,851,257 B1 * 2/2005 Yoshida et al. ..... 60/299
7,458,866 B2 * 12/2008 Nakamura et al. ..... 440/75

FOREIGN PATENT DOCUMENTS

JP 07-144695 A 6/1995
JP 2717975 B2 11/1997
JP 2747725 B2 5/1998

* cited by examiner

*Primary Examiner*—Lars A Olson
*Assistant Examiner*—Daniel V Venne
(74) *Attorney, Agent, or Firm*—Keating and Bennett, LLP

(57) ABSTRACT

An outboard motor has a construction in which the area of an exhaust passage can be secured easily and exhaust noise is less likely to escape into the air, allowing the exhaust noise to be lowered. The outboard motor includes a lower case, a propeller shaft rotatably supported in the lower case, a propeller fixed to the propeller shaft, an engine, and a power transmission mechanism through which a driving force from the engine is transmitted to the propeller shaft to rotate the propeller. An exhaust case is provided in the lower case. The exhaust case includes an upper exhaust passage above the propeller shaft, the upper exhaust passage directing therethrough an exhaust gas from the engine, an exhaust outlet which is open in a rearward direction of the propeller shaft, and a communication exhaust passage arranged to communicate the upper exhaust passage with the exhaust outlet.

11 Claims, 5 Drawing Sheets

OUTBOARD MOTOR

BACKGROUND OF THE INVENTION

1. Field of the Invention

The present invention relates to an outboard motor which can emit an exhaust gas from an engine into water.

2. Description of the Related Art

Outboard motors are provided with an exhaust passage through which an exhaust gas from an engine can be emitted into water. Typically, the exhaust passage is formed through a boss of a propeller. An exhaust gas can pass through the exhaust passage in the propeller boss and then be emitted from the rear end of the propeller. See, for example, Japanese Patent No. 2747725 and JP-A-Hei 7-144695.

Meanwhile, the exhaust passage needs to have a size corresponding to the output of the outboard motor. For example, the outboard motor having high output emits a larger amount of exhaust gas from the engine. In this case, an exhaust passage having a larger sectional area is required. Therefore, for example, one outboard motor has a propeller disposed in front of the lower case (Japanese Patent No. 2717975), and another outboard motor is designed to emit an exhaust gas from the upper case rearward of the propeller (JP-B-Hei 7-74033).

In the conventional structure of emitting an exhaust disclosed in Japanese Patent No. 2747725 and JP-A-Hei 7-144695, the exhaust passage is formed in the boss of the propeller. In such structures, however, only a limited passage area is obtained in the propeller boss. Besides, exhaust pressure will necessary increase due to the sectional area of the passage.

In Japanese Patent No. 2717975, since the propeller is arranged in front of the lower case, the propeller may hit against an obstacle in the sea.

In JP-B-Hei 7-74033, since an exhaust outlet is formed above the propeller, the exhaust outlet may be exposed above the water surface, and thus exhaust noise is more likely to escape into the ambient air.

SUMMARY OF THE INVENTION

In order to solve the foregoing problems, preferred embodiments of the present invention provide an outboard motor in which an area of an exhaust passage can be secured easily and exhaust noise is less likely to escape into the air, allowing the exhaust noise to be lowered.

According to a preferred embodiment of the present invention, an outboard motor includes a lower case, a propeller shaft rotatably supported in the lower case, a propeller fixed to the propeller shaft, an engine, a power transmission mechanism through which a driving force from the engine is transmitted to the propeller shaft to rotate the propeller, and an exhaust case through which an exhaust gas from the engine is emitted into water, the exhaust case including an upper exhaust passage above the propeller shaft, the upper exhaust passage directing therethrough an exhaust gas from the engine, an exhaust outlet which is open in a rearward direction of the propeller shaft, and a communication exhaust passage arranged to communicate the upper exhaust passage with the exhaust outlet.

The propeller is preferably provided on a propeller boss, and a damper is preferably disposed between the propeller boss and the propeller shaft.

A section defining the exhaust outlet of the exhaust case preferably is arranged to rotatably support the rear end of the propeller shaft.

The power transmission mechanism preferably includes a transmission having an input shaft connected to the engine and an output shaft connected to the propeller shaft, the transmission being capable of varying a speed ratio between the input shaft and the output shaft.

The outboard motor also preferably includes a first propeller shaft arranged to rotate a first propeller, a second propeller shaft arranged to rotate a second propeller, and a contra-rotating propeller mechanism arranged to rotate the first propeller and the second propeller in opposite directions relative to each other.

The exhaust case is preferably fastened at its top to the lower case, and the upper exhaust passage communicates with an exhaust passage of an upper case.

The exhaust outlet preferably has substantially the same diameter as the propeller boss of the propeller.

A lateral width of the section defining the communication exhaust passage of the exhaust case is preferably smaller than a lateral width of a torpedo section of the lower case.

In accordance with a preferred embodiment of the present invention, the exhaust case includes an upper exhaust passage above the propeller shaft, the upper exhaust passage directing therethrough an exhaust gas from the engine, an exhaust outlet which is open in a rearward direction of the propeller shaft, and a communication exhaust passage for communicating the exhaust passage with the exhaust outlet. Accordingly, the larger area of the exhaust passage can be obtained easily. Further, the outside diameter of the propeller boss can be decreased, and thus reaction from water against the lower case and the propeller boss is also decreased. Further, the flow of water in a rearward direction of the propellers assists emission of an exhaust gas, which leads to further decreased exhaust pressure, thereby preventing entanglement of the exhaust gas. Furthermore, exhaust noise is less likely to escape into the air, allowing exhaust noise to be lowered.

Since no exhaust passage preferably is provided in the propeller boss, it is possible to arrange the damper therein. In case of the propeller hitting against any obstacle under the sea, the damper can provide a shock-absorbing function.

The section defining the exhaust outlet of the exhaust case preferably rotatably supports the rear end of the propeller shaft to thereby hold the propeller shaft at it both ends. As a result, a load on gears of the power transmission mechanism can be reduced, and thus the diameter of those gears can be decreased. Consequently, the diameter of the torpedo section is decreased, which suppresses reaction to the lower case.

The power transmission mechanism preferably includes a transmission capable of varying a speed ratio between the input side and the output side. As a result, satisfactory driving torque characteristics can be achieved by selecting a high speed ratio especially during traveling at low speeds, and the starting and acceleration performance and deceleration and braking performance can be improved dramatically by utilizing its maximum propeller performance.

A contra-rotating propeller mechanism is preferably provided for rotating the first propeller and the second propeller in opposite directions relative to each other. As a result, the total area of propeller blades becomes larger than that of a single propeller for generating a thrust. Thus, excellent propeller cavitation performance is achieved.

Since the top of the exhaust case is preferably fastened to the lower case, the upper exhaust passage can communicate with the exhaust passage of the upper case easily.

Since the exhaust outlet preferably has substantially the same diameter of the propeller boss of the propeller, reaction from water can be lowered.

The lateral width of the section defining the communication exhaust passage of the exhaust case is preferably smaller than the lateral width of the torpedo section of the lower case. Thus, reaction from water can be decreased.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

A description will hereinafter be made of a preferred embodiment of the outboard motor according to the present invention. The shown embodiment is the preferred embodiment of the present invention and is not intended to be limiting.

Figure 1:
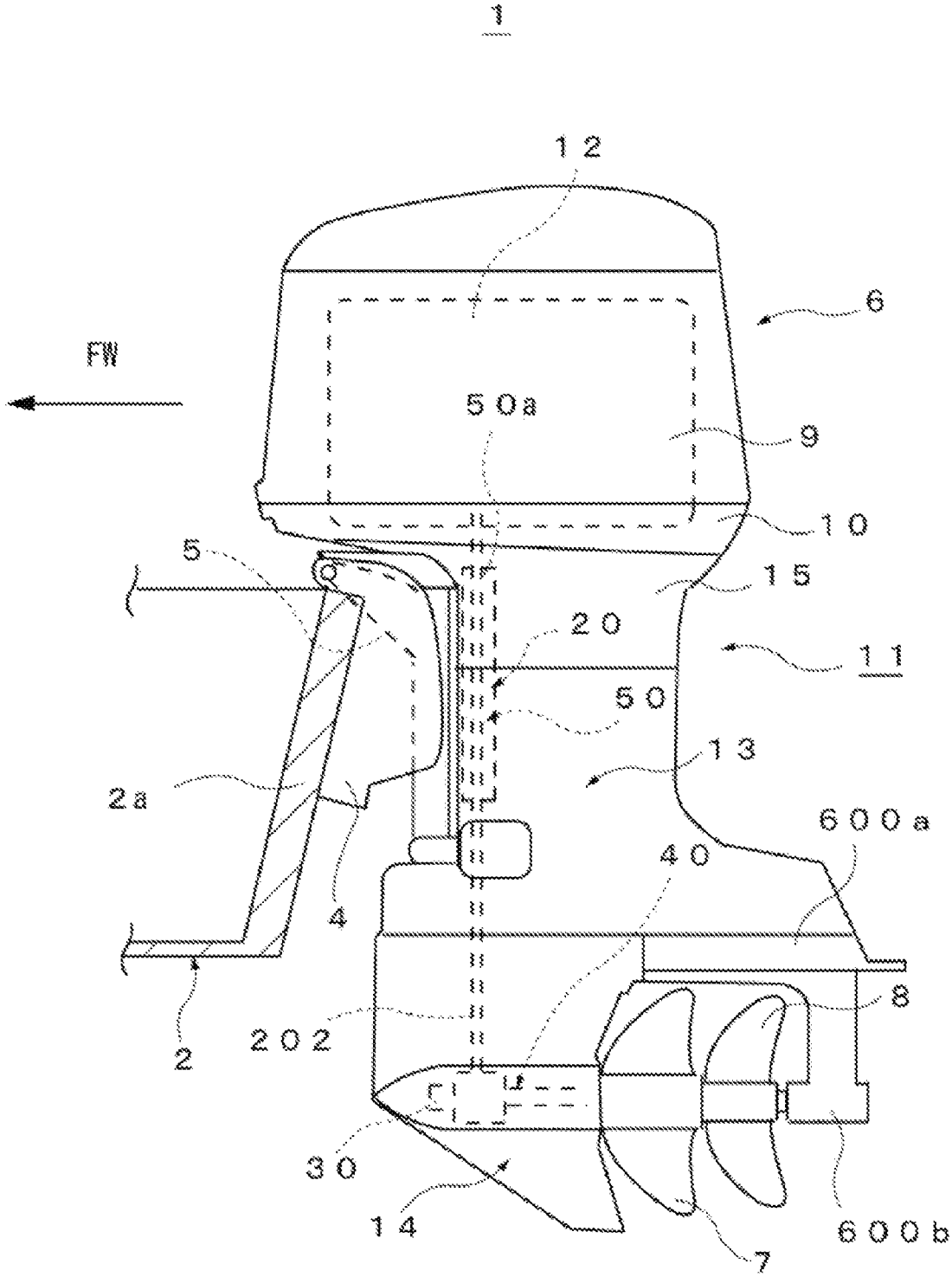
FIG. 1 is a side elevation of an outboard motor mounted on a watercraft according to a preferred embodiment of the present invention.
Figure 2:
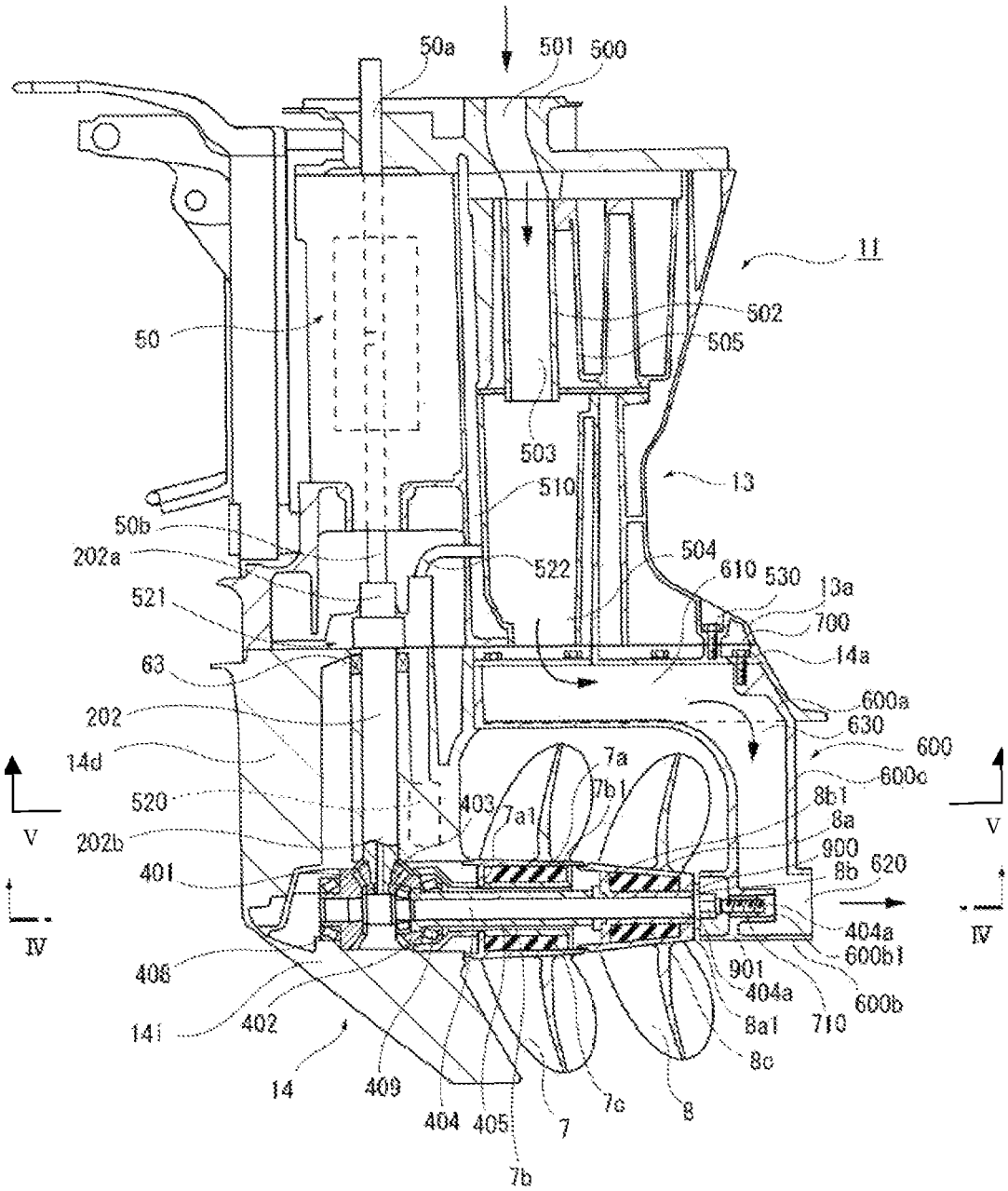
FIG. 2 is a sectional view of a power transmission mechanism, a contra-rotating propeller mechanism and an exhaust passage of the outboard motor.
Figure 3:
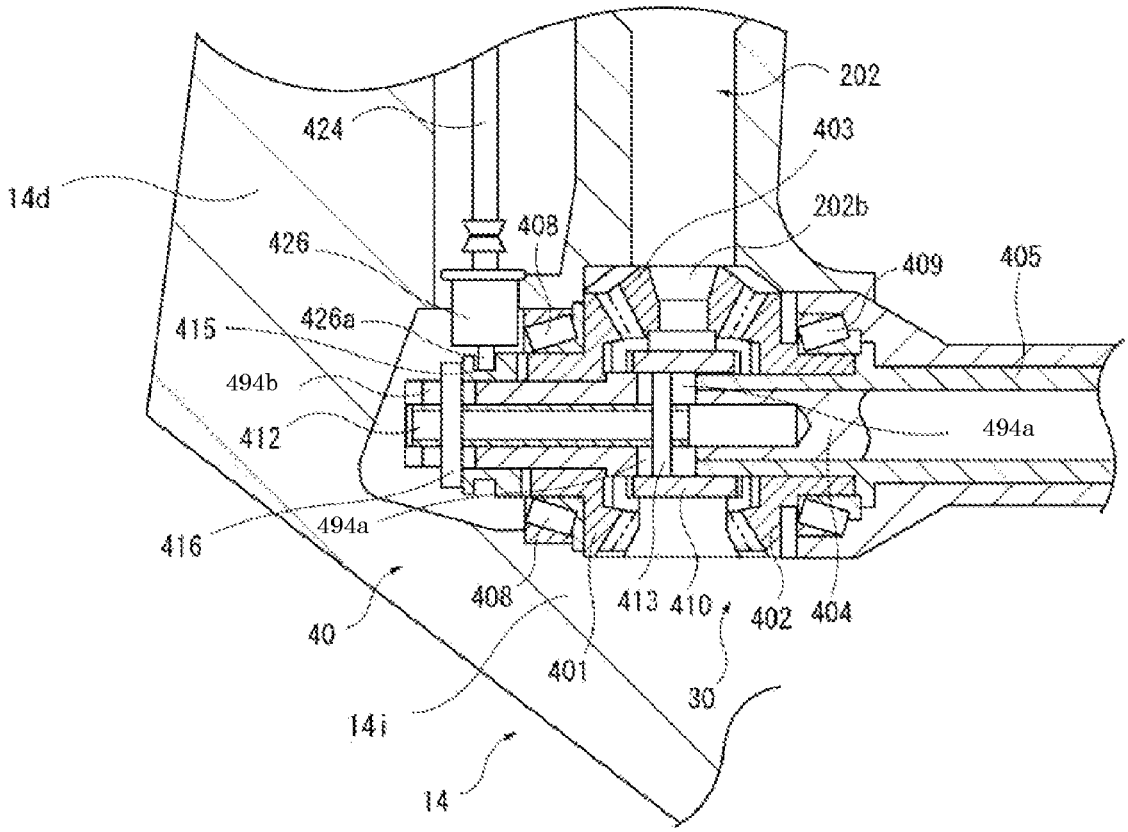
FIG. 3 is a partial enlarged view of the contra-rotating propeller mechanism.
Figure 4:
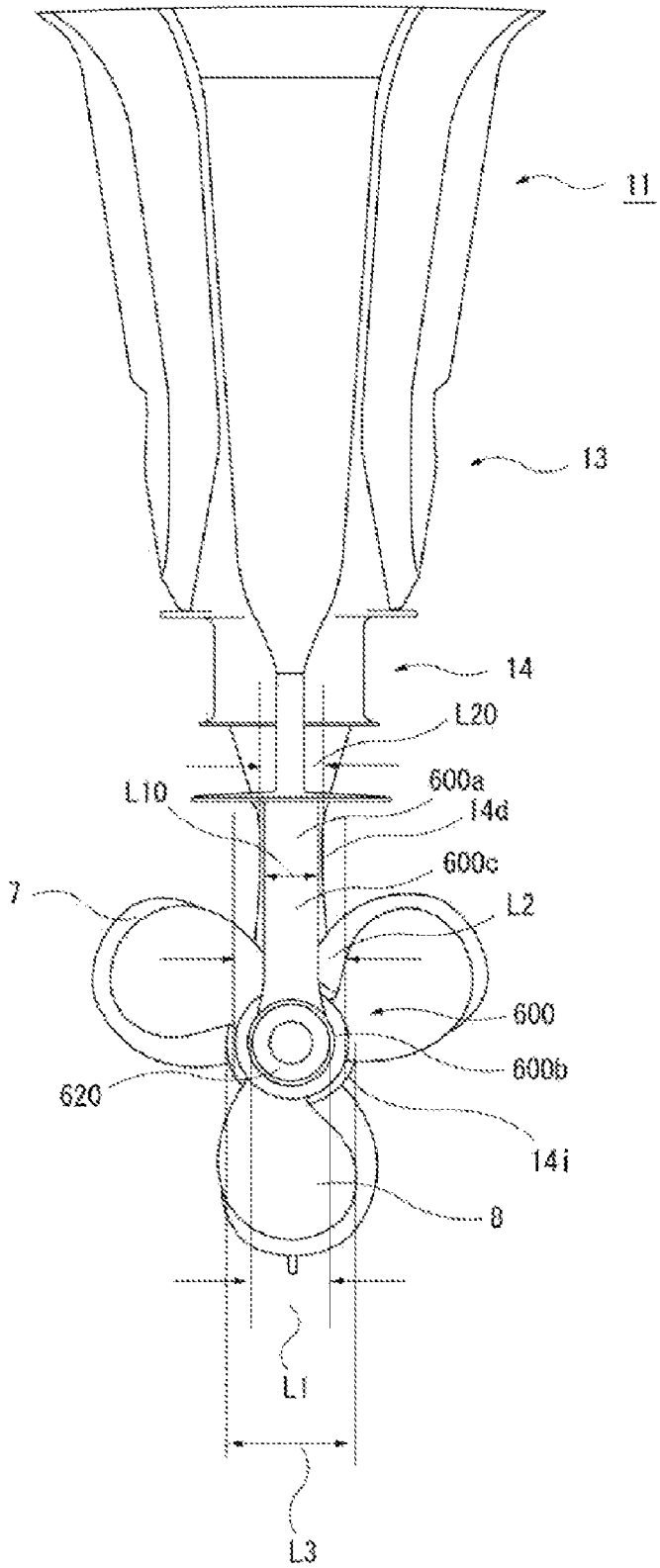
FIG. 4 illustrates a casing of the outboard motor seen from a rearward direction thereof.
Figure 5:
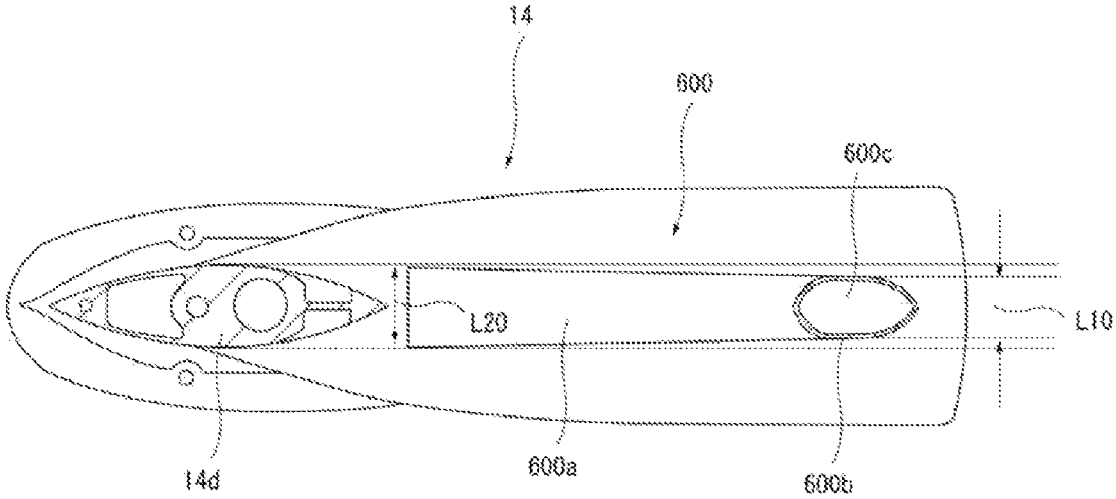
FIG. 5 is a sectional view taken along the line V-V in FIG. 2.

FIG. 1 is a side elevation of an outboard motor mounted to a watercraft; FIG. 2 is a cross-sectional view of a power transmission mechanism, a contra-rotating propeller mechanism and an exhaust passage of the outboard motor; FIG. 3 is a partial enlarged view of the contra-rotating propeller mechanism; FIG. 4 illustrates a casing of the outboard motor seen from the rear side thereof in a direction in which the watercraft is driven; and FIG. 5 is a cross-sectional view taken along the line V-V in FIG. 2. In FIG. 1, the arrow FW indicates a forward direction in which a watercraft 1 is driven. It should be noted that as used herein, the term "left and right," which will be described below, refers to a direction seen in the forward direction in which the watercraft is driven.

In this preferred embodiment, as shown in FIG. 1, the watercraft 1 has a hull 2 including a transom 2*a*, to which a clamp bracket 4 is secured. To the clamp bracket 4, a swivel bracket 5 is attached for up-and-down pivotal movement. To the swivel bracket 5, an outboard motor 6 is mounted for lateral pivotal movement. The outboard motor 6 includes a first propeller 7 and a second propeller 8 arranged in series on the fore-and-aft sides, respectively.

The outboard motor 6 includes an upper cowl 9, a bottom cowl 10, and a casing 11. In a space defined by the upper cowl 9 and the bottom cowl 10, there is disposed an engine 12. The casing 11 is formed by an upper case 13 and a lower case 14. The top of the upper case 13 is covered with an apron 15.

In the upper case 13 and the lower case 14 forming together the casing 11, there are provided a power transmission mechanism 20 for transmitting the power from the engine 12 to the second propeller 8 and the first propeller 7; a forward-reverse switching mechanism 30 for selectively shifting between forward, reverse and neutral; and a contra-rotating propeller mechanism 40 for rotating the first propeller 7 and the second propeller 8 in opposite directions relative to each other.

The power transmission mechanism 20 includes a transmission 50. As shown in FIG. 2, the transmission 50 has an input shaft 50*a* extending through an exhaust guide 500, preferably made of aluminum alloy, and connected to the engine, and an output shaft 50*b* connected to propeller shafts. The transmission can vary the speed ratio between the input shaft 50*a* and the output shaft 50*b*. The engine side of the input shaft 50*a* may be connected to the crankshaft of the engine 12 directly or via a gear mechanism. The propeller shaft side of the output shaft 50*b* is connected to the upper end 202*a* of a drive shaft 202. The drive shaft 202 is rotatably supported by the lower case 14 via a bearing 63, and can transmit output from the transmission 50 to the contra-rotating propeller mechanism 40. The transmission 50 can vary the speed ratio between the input side and the output side depending on engine speed and engine operating conditions.

The contra-rotating propeller mechanism 40 has two driven gears 401, 402 for driving the first propeller 7 and the second propeller 8, respectively, and a pinion gear 403 for driving the two driven gears 401, 402 together. A first propeller shaft 404 is rotatably supported by a second propeller shaft 405. The pinion gear 403 is secured to the lower end 202*b* of the drive shaft 202 for rotation therewith, and couples the output side of the transmission 50 to the pinion gear 403. As the driven gears 401, 402 and the pinion gear 403, bevel gears are preferably used individually. The pinion gear 403 disposed horizontally is in meshing engagement with the two driven gears 401, 402 arranged to oppose each other.

The two driven gears 401,402 are supported on the first propeller shaft 404, which extends to the second propeller 8 on the aft side. The driven gear 402 is supported on the second propeller shaft 405, which extends to the first propeller 7 on the fore side.

The first propeller 7 is provided at the rear end of the second propeller shaft 405 extending rearward from the lower case 14 for rotation with the second propeller shaft 405. Behind the first propeller 7, the second propeller 8 is provided at the rear end of the first propeller shaft 404 extending rearward from the second propeller shaft 405 for rotation with the first propeller 404.

The first propeller 7 and the second propeller 8 are provided on propeller bosses 7*a*, 8*a*. To the rear end 404*a* of the first propeller shaft 404, a nut 901 is fastened via a washer 900, thereby preventing the propeller bosses 7*a*, 8*a* from coming off.

Inner tubes 7*b*, 8*b* are disposed inside the propeller bosses 7*a*, 8*a*. The propeller boss 7*a* has an inward flange 7*a*1 on the fore side, and the propeller boss 8*a* has an inward flange 8*a*1 on the aft side. The inner tube 7*b* has an outward flange 7*b*1 on the aft side, and the inner tube 8*b* has an outward flange 8*b*1 on the fore side.

Between the propeller bosses 7*a*, 8*a* and the associated inner tubes 7*b*, 8*b*, dampers 7*c*, 8*c* are respectively provided by baking process. The damper 7*c* is limited from moving in a direction of the propeller shaft, by the inward flange 7*a*1 of the propeller boss 7*a* and the outward flange 7*b*1 of the inner tube 7*b*. The damper 8*c* is limited from moving in a direction of the propeller shaft, by the inward flange 8*a*1 of the propeller boss 8*a* and the outward flange 8*b*1 of the inner tube 8*b*. In such manner, the damper 7*c* is arranged between the propeller boss 7*a* and the second propeller shaft 405 via the inner tube 7*b*, and the damper 8*c* is arranged between the propeller boss 8*a* and the first propeller shaft 404 via the inner tube 8*b*. In this preferred embodiment, no exhaust passage is provided in the propeller bosses 7*a*, 8*a*, making it possible to arrange the dampers 7*c*, 8*c* therein. In case of the first propeller 7 and the second propeller 8 hitting against any obstacle in the sea, the dampers 7*c*, 8*c* can provide a shock-absorbing function.

The driven gear 402, rotatably supported by a bearing 408, is disposed around the front end of the first propeller shaft 404 for free rotation, and the driven gear 401, rotatably supported by a bearing 409, is disposed behind the driven gear 402 and around the front end of the second propeller shaft 405 for free rotation.

Between the first propeller shaft 404 and the front peripheral end of the second propeller shaft 405 and inside the paired fore and aft driven gears 401, 402, a clutch 410 is spline-fitted for fore-and-aft sliding movement.

Further, a plunger 412 is fitted in a central part of the front end of the first propeller shaft 404 for fore-and-aft sliding movement. A pin 413 extends vertically through an axially elongated hole 494*a* disposed through the first propeller shaft 404. The clutch 410 is coupled to the plunger 412 with the pin 413.

Thus, to the extent that the plunger 412 is movable through an axial central hole of the first propeller shaft 404, the clutch 410 is slidable in the fore-and-aft direction via the pin 413. As the clutch moves forward, it will be brought into engagement with the driven gear 401. As the clutch moves rearward, it will be brought into engagement with the driven gear 402.

A slider 415 is provided in a forward direction of the first propeller shaft 404. A pin 416 extends vertically through an axially elongated hole 494*b* disposed through the front end of the first propeller shaft 404. The pin 416 is fixed at its both ends to the slider 415. A shift cam 426 is attached to the lower end of a shift rod 424 disposed above the slider 415. An eccentric pin 426*a* offset from the axis (rotation center) of the shift rod 424 projects from the lower end of the shift cam 426. The eccentric pin 426*a* is in engagement with the outer periphery of the slider 411.

As a shift lever (not shown) is operated to rotate the shift rod 424 about its axis, the eccentric pin 426*a* of the shift cam 426 will rotate in a manner sliding the slider 415 in the fore-and-aft direction together with the plunger 412.

In the outboard motor 6 in accordance with this preferred embodiment, as the engine 12 is driven, a driving force from the engine 12 is transmitted to the transmission 50 to rotate the drive shaft 202 in a manner transmitting output from the transmission 50 to the contra-rotating propeller mechanism 40. As the drive shaft 202 is rotated in one direction, the rotation of the drive shaft 202 will be transmitted to the paired, two fore and aft driven gears 401, 402 via the pinion gear 403, allowing the two driven gears 401, 402 to rotate invariably in opposite directions to each other.

When the shift lever (not shown) is set to a "neutral position," the slider 415 and the plunger 412 are held in a neutral state in which the clutch 410 is in meshing engagement with neither of the two driven gears 401, 402 as shown in FIG. 3. At this time, both the driven gears 401, 402 rotate freely (idle) and the rotation of the drive shaft 202 is not transmitted to the first propeller shaft 404 and the second propeller shaft 405. As a result, in the neutral state, neither the first propeller 7 nor the second propeller 8 arranged on the fore and aft sides, respectively, rotates and no propulsive force is generated.

Then, when the shift lever is set to a "forward position," the shift rod 424 and the shift cam 426 rotate by a certain angle in a manner rotating the eccentric pin 426*a* of the shift cam 426 to slide the slider 415 rearward together with the plunger 412. The clutch 410 is then brought into meshing engagement with the aft driven gear 402, thereby moving away from the fore driven gear 401.

As a result, the rotation of the drive shaft 202 is transmitted to the second propeller shaft 405 via the pinion gear 403 and the driven gear 402 and the clutch 410 and also to the first propeller shaft 404 via the pinion gear 403 and the driven gear 401. This allows rotation of the second propeller shaft 405 and the first propeller 7 attached thereto and the first propeller shaft 404 and the second propeller 8 attached thereto in opposite directions relative to each other. When the watercraft is driven forward, contra-rotation mode, in which the first propeller 7 and the second propeller 8 arranged on the fore and aft sides, respectively, are rotated in opposite directions relative to each other, is achieved as described above. Thus, high propulsive efficiency can be achieved by the first propeller 7 and the second propeller 8.

Then, when the shift lever (not shown) is set to a "reverse position," the shift rod 424 and the shift cam 426 rotate in a certain direction by a certain angle in a manner rotating the eccentric pin 426*a* of the shift cam 426 to slide the slider 415 forward together with the plunger 412. The clutch 410 is then brought into meshing engagement with the aft driven gear 401, thereby moving away from the aft driven gear 402. That is, the clutch 410 is brought out of engagement with the aft driven gear 402 and then into meshing engagement with the fore driven gear 401.

AS a result, the rotation of the drive shaft 202 is transmitted only to the first propeller shaft 404 via the fore driven gear 401 and the clutch 410, and no rotation of the drive shaft is transmitted to the second propeller shaft 405. Thus, only the first propeller shaft 404 and the second propeller 8 attached thereto rotate in a direction opposite to that during the forward running.

As described above, since only the second propeller 8 rotates when the watercraft is driven in reverse as described above, the first propeller 7 in a stationary state does not interfere with the rotation of the second propeller 8. Therefore, the second propeller 8 provides high propulsive efficiency and a sufficient propulsive force can be achieved. Further, the contra-rotating propeller mechanism 40 is provided. As a result, the total area of propeller blades becomes larger than that of a single propeller for generating a thrust. Thus, excellent propeller cavitation performance is achieved.

The engine 12 is fixedly mounted on the exhaust guide 500. An oil pan 505 arranged in the upper case 13 is suspended and attached to the underside of the exhaust guide 500. To a central part of the oil pan 505, an exhaust pipe 502 is attached. In a position below the oil pan 505, there is provided an expansion chamber 504. An exhaust gas from the engine 12 flows into the expansion chamber 504 through an exhaust passage 501 in the exhaust guide 500 and an exhaust passage 503 of the exhaust pipe 502.

On the outside of the expansion chamber 504 and on the outside of the oil pan 505, a cooling water jacket 510 extends downward from their respective upper ends. Water outside of the outboard motor 6 sucked through a cooling water inlet 520, or cooling water, is pumped up with a cooling water pump 521. The water is then delivered to the engine 12 and others through a pipe 522 or the like to cool them. Thereafter, the cooling water that cooled the engine 12 and other elements are emitted outside of the outboard motor 6. Part of such cooling water flows into the upper end of the cooling water jacket 510 to cool the outside of the oil pan 505 and the outside of the expansion chamber 504, and is then discharged through the lower end of the cooling water jacket 510.

A lower part 13*a* of the upper case 13 is fastened to an upper part 14*a* of the lower case 14 with bolts 530 from above. An exhaust case 600 is provided behind the lower case 14. The exhaust case 600 is an integral part preferably formed of aluminum alloy, a reinforced resin material, or the like. The exhaust case 600 includes a section 600*a* defining an upper exhaust passage 610 through which an exhaust from the engine 12 is directed; a section 600*b* defining an exhaust outlet 620 which is open in a rearward direction of the propeller shafts; and a section 600*c* defining a communication exhaust passage 630 for communicating the upper exhaust passage 610 and the exhaust outlet 620.

The exhaust case 600 is fastened at its topside to the upper part 14*a* of the lower case 14 with bolts 700 from above. The section 600*a* defining the upper exhaust passage 610 extends in a direction in which the watercraft 1 is driven, and is positioned above the propeller shafts. A front part of the upper exhaust passage 610 communicates with the expansion chamber 504 forming an exhaust passage of the upper case 13. The upper exhaust passage 610 can thus communicate with the exhaust passage of the upper case 13 easily.

The section 600*b* defining the exhaust outlet 620 of the exhaust case 600 is preferably substantially cylindrical. The exhaust outlet 620 is open rearward to emit an exhaust gas. The section 600*b* defining the exhaust outlet 620 has a tubular hollow part 600*b*1. The rear end 404*a* of the first propeller shaft 404 is rotatably supported in the hollow part 600*b*1 via a slide bearing 710. As such, the section 600*b* defining the exhaust outlet 620 of the exhaust case 600 rotatably supports the rear end of the first propeller shaft 404. The front end of the first propeller shaft 404 is supported by the lower case 14. As a result, the first propeller shaft 404 is supported reliably with being held at its both ends. Since the first propeller shaft 404 is supported reliably with being held at its both ends, a section 14*i* of the lower case 14 which supports the front end of the first propeller shaft 404 can be of a smaller thickness than the conventional one. In addition, a load applied to the pinion gear 403 and the like of the power transmission mechanism can be lower, making it possible to decrease the diameter of those gears. The section 14*i* of the lower case 14 which supports the front end of the first propeller shaft 404 can be of a smaller thickness. A torpedo section 14*d* connected to the section 14*i* which supports the front end of the first propeller shaft 404 can thereby be of a smaller lateral width, which suppresses reaction from water.

As shown in FIG. 4, the outside diameter L1 of the exhaust outlet 620 preferably is substantially the same as the outside diameter L2 of the propeller bosses 7*a*, 8*a* of the propeller shaft. As a result, a reaction from water can be decreased.

The section 600*c* defining the communication exhaust passage 630 of the exhaust case 600 is positioned behind the lower case 14. The section 600*a* defining the upper exhaust passage 610 and the section 600*c* defining the communication exhaust passage 630 define a space which surrounds an upper part of the first propeller 7 and the second propeller 8. As shown in FIG. 5, the lateral width L10 of the section 600*c* defining the communication exhaust passage 630 is preferably smaller than the lateral width L20 of the torpedo section 14*d* of the lower case 14. Thus, a reaction from water can be decreased.

In this preferred embodiment, the exhaust case 600 is provided in the lower case 14. However, the exhaust case 600 may also be provided in the upper case 13. The exhaust case 600 includes the upper exhaust passage 610 positioned above the propeller shaft and through which an exhaust gas from the engine 12 is directed; the exhaust outlet 620 that is open in a rearward direction of the propeller shaft; and the communication exhaust passage 630 for communicating the upper exhaust passage 610 and the exhaust outlet 620. Since an exhaust gas passes from the upper exhaust passage 610 through the communication exhaust passage 630 to be emitted through the exhaust outlet 620 into the water, no exhaust passage is formed in the propeller bosses 7*a*, 8*a* as in the conventional art. Accordingly, the larger area of the exhaust passage can be obtained easily independently of the propeller bosses 7*a*, 8*a*. Further, since no exhaust passage is formed in the propeller bosses 7*a*, 8*a*, the diameter of the propeller bosses 7*a*, 8*a* can be decreased correspondingly, and thus a reaction from water against the lower case 14 and the propeller bosses 7*a*, 8*a* can be decreased. Further, the flow of water in a rearward direction of the propellers assists emission of an exhaust gas, which leads to further reduced exhaust pressure, thereby preventing entanglement of the exhaust gas. The exhaust outlet 620 is positioned in a rearward direction of the propellers. Since an exhaust gas is emitted through the exhaust outlet 620 into water, exhaust noise is less likely to escape into the air, allowing exhaust noise to be lowered.

Further, as shown in FIG. 4, since the outside diameter L1 of the exhaust outlet 620 is smaller than the outside diameter L2 of the propeller bosses 7*a*, 8*a*, reaction from water can be reduced further. The outside diameter L1 of the exhaust outlet 620 can be smaller than the lateral width L3 of the lower case 14 around the propeller shafts to thereby decrease reaction from the flow of water. Further, the upper exhaust passage 610 is preferably arranged substantially parallel to the propeller shafts. This allows forming the first propeller 7 and the second propeller 8 to have the generally same size. Further, the communication exhaust passage 630 extending downward from the rear end of the upper exhaust passage 610 is arranged to be perpendicular or substantially perpendicular to the propeller shafts. This allows rotatably supporting a rear part of the first propeller shaft 404 reliably with a more compact structure.

It is understood that in this preferred embodiment, the transmission 50 of the power transmission mechanism 20 is arranged on the drive shaft. However, the present invention is not limited to this, and the transmission may be arranged on an extended part of the crankshaft of the engine 12, for example. As such, since the transmission 50 is provided, satisfactory driving torque characteristics can be achieved by selecting a high speed ratio especially during traveling at low speeds, and the starting and acceleration performance and deceleration and braking performance can be improved dramatically by utilizing its maximum propeller performance.

Further, various planetary gear mechanisms, such as of simple planetary type or of dual planetary type, can be used as the transmission 50. Further, the transmission 50 is not limited to the planetary gear mechanism. The power transmission mechanism 20 may be provided with a torque converter device. Further, the contra-rotating propeller mechanism 40 can be used for the outboard motor described in JP-A-Hei 6-221383, JP-A-Hei 9-263294 or the like.

The present invention is applicable to an outboard motor which can emit an exhaust gas from an engine into water. According to preferred embodiments of the present invention, the area of the exhaust passage can be secured easily, and exhaust noise is less likely to escape into the air, allowing the exhaust noise to be lowered.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

a lower case;

a propeller shaft rotatably supported in the lower case;

a propeller fixed to the propeller shaft, the propeller positioned in a rear of the lower case;

an engine;

a power transmission mechanism through which a driving force from the engine is transmitted to the propeller shaft to rotate the propeller; and an exhaust case through which an exhaust gas from the engine is emitted into water, the exhaust case including:

an upper exhaust passage above the propeller shaft, the upper exhaust passage directing therethrough an exhaust gas from the engine;

an exhaust outlet which is open in a rearward direction of the propeller shaft; and a communication exhaust passage arranged to communicate the upper exhaust passage with the exhaust outlet, and the communication exhaust passage is positioned rearward of the propeller; wherein the lower case supports a forward end of the propeller shaft, and a section defining the exhaust outlet of the exhaust case rotatably supports a rear end of the propeller shaft, the rear end of the propeller shaft being located on an opposite side of the propeller from the forward end of the propeller shaft.

2. The outboard motor according to claim 1, wherein the propeller is provided on a propeller boss, and a damper is disposed between the propeller boss and the propeller shaft.

3. The outboard motor according to claim 1, wherein the power transmission mechanism includes a transmission having an input shaft connected to the engine and an output shaft connected to the propeller shaft, the transmission being arranged to vary a speed ratio between the input shaft and the output shaft.

4. The outboard motor according to claim 1, further comprising:

a first propeller shaft arranged to rotate a first propeller;

a second propeller shaft arranged to rotate a second propeller; and a contra-rotating propeller mechanism arranged to rotate the first propeller and the second propeller in opposite directions relative to each other.

5. The outboard motor according to claim 1, wherein the exhaust case is fastened at a top to the lower case, and the upper exhaust passage communicates with an exhaust passage of an upper case.

6. The outboard motor according to claim 1, wherein the exhaust outlet has substantially the same diameter as the propeller boss of the propeller.

7. The outboard motor according to claim 1, wherein a lateral width of the section defining the communication exhaust passage of the exhaust case is smaller than a lateral width of a torpedo section of the lower case.

8. outboard motor according to claim 1, wherein the communication exhaust passage is positioned immediately behind the propeller.

9. The outboard motor according to claim 1, wherein the communication exhaust passage is arranged to extend perpendicular to or substantially perpendicular to the propeller shaft.

10. The outboard motor according to claim 1, wherein the communication exhaust passage is arranged to extend behind an entire upper half of the propeller.

11. The outboard motor according to claim 1, wherein the upper exhaust passage is substantially parallel to the propeller shaft.

* * * * *